US012209222B2

(12) United States Patent
Gnanasekaran et al.

(10) Patent No.: US 12,209,222 B2
(45) Date of Patent: Jan. 28, 2025

(54) SIMULTANEOUS PRODUCTION OF HIGH VALUE DE-AROMATIZED KEROSENE AND BTX FROM REFINERY HYDROCARBONS

(71) Applicant: Hindustan Petroleum Corporation Limited, Bangalore (IN)

(72) Inventors: Valavarasu Gnanasekaran, Bengaluru (IN); Pradyut Kumar Dhar, Bengaluru (IN); Kanala Raghava Krishna, Bengaluru (IN); Ramesh Kandanelli, Bengaluru (IN); Ravi Balasubramaniam, Bengaluru (IN); Bojja Ramachandra Rao, Bengaluru (IN)

(73) Assignee: Hindustan Petroleum Corporation Limited, Bengaluru (IN)

( * ) Notice: Subject to any disclaimer, the term of this patent is extended or adjusted under 35 U.S.C. 154(b) by 152 days.

(21) Appl. No.: 17/916,447

(22) PCT Filed: Mar. 9, 2021

(86) PCT No.: PCT/IN2021/050227
§ 371 (c)(1),
(2) Date: Sep. 30, 2022

(87) PCT Pub. No.: WO2021/199060
PCT Pub. Date: Oct. 7, 2021

(65) Prior Publication Data

US 2023/0145086 A1 May 11, 2023

(30) Foreign Application Priority Data

Mar. 30, 2020 (IN) ..... 202041014109

(51) Int. Cl.
*C10G 21/16* (2006.01)
*C10G 67/04* (2006.01)

(52) U.S. Cl.
CPC ..... *C10G 21/16* (2013.01); *C10G 67/0436* (2013.01); *C10G 67/0445* (2013.01); *C10G 2300/1051* (2013.01); *C10G 2300/202* (2013.01); *C10G 2300/4006* (2013.01); *C10G 2300/4012* (2013.01); *C10G 2300/44* (2013.01); *C10G 2400/08* (2013.01); *C10G 2400/30* (2013.01)

(58) Field of Classification Search
CPC ..... C10G 21/16; C10G 67/0409; C10G 67/0418; C10G 67/0436; C10G 67/0445
See application file for complete search history.

(56) References Cited

U.S. PATENT DOCUMENTS

| | | | | |
|---|---|---|---|---|
| 2,176,746 A | 10/1939 | Pokorny et al. | | |
| 2,792,332 A | 5/1957 | Hutchings | | |
| 4,083,772 A * | 4/1978 | Asselin | C10G 21/28 208/321 | |
| 4,498,980 A | 2/1985 | Forte | | |
| 8,778,170 B2 | 7/2014 | Long et al. | | |
| 11,046,900 B2 | 6/2021 | Housmans et al. | | |
| 2015/0210941 A1* | 7/2015 | Hao | C10G 21/28 585/866 | |

FOREIGN PATENT DOCUMENTS

KR 10-2019-0042778 A 4/2019

OTHER PUBLICATIONS

International Search Report and Written Opinion for PCT/IN2020/050227, dated May 26, 2021, 11 pgs.
G. Alfke, et al., "Oil Refining", Ullmann's Encyclopedia of Industrial Chemistry, Jan. 15, 2007, 56 pgs.

* cited by examiner

*Primary Examiner* — Renee Robinson
(74) *Attorney, Agent, or Firm* — BLANK ROME LLP

(57) ABSTRACT

The present disclosure discloses a process for obtaining an aromatic lean stream and an aromatic rich stream from a hydrocarbon feed, the process comprising: (a) obtaining a hydrocarbon feed; and (b) contacting the hydrocarbon feed with a solvent selected from a group consisting of alkyl aromatic hydrophilic polyethylene oxide, polyethylene glycols, and combinations thereof to obtain an aromatic lean stream and an aromatic rich stream. It further discloses a simultaneous process to obtain an aromatic lean stream and an aromatic rich stream. The present disclosure also discloses a process for obtaining de-aromatized kerosene from a hydrocarbon feed. Additionally, the present disclosure discloses a process for obtaining BTX from a hydrocarbon feed.

20 Claims, No Drawings

SIMULTANEOUS PRODUCTION OF HIGH VALUE DE-AROMATIZED KEROSENE AND BTX FROM REFINERY HYDROCARBONS

RELATED APPLICATIONS

The present application is a national phase of PCT/IN2021/050227, filed Mar. 9, 2021, which claims the benefit of Indian patent application No. 202041014109, filed Mar. 30, 2020. The entire disclosures of which are hereby incorporated by reference.

FIELD OF THE INVENTION

The present disclosure, in general, relates to the field of processing crude hydrocarbon feed in the petrochemical refinery units and particularly relates to a process for the production of de-aromatized kerosene and benzene, toluene, xylene (BTX) from crude hydrocarbon feed in the petrochemical refineries.

BACKGROUND OF THE INVENTION

Petroleum refining industry processes crude oil into refined products, such as liquefied petroleum gas (LPG), gasoline, kerosene, aviation fuel, diesel fuel, fuel oils, lubricating oils, and feedstocks for the petrochemical industry. Numerous criteria are involved in obtaining desired refined products, including various processes, such as distillation, cracking, reforming, coking, visbreaking, and so on. Some of the refined products obtained from the crude oil, high-value low aromatic hydrocarbon solvents, and high-value BTX have various industrial applications. These solvents can be effectively used for printing inks, paints and coatings, metal working fluids, industrial and institutional cleaning, adhesives and sealants, and in many other consumer products. There has been constant research in the petrochemical industry for arriving at an efficient conversion process for the production of these solvents from hydrocarbons.

U.S. Pat. No. 8,778,170B2 discloses a process for producing light olefins and aromatics by reacting petroleum hydrocarbons with catalytic cracking catalysts in two different reaction zones. KR20190042778A provides a process for producing petrochemicals and fuel products from crude oil feedstocks using various distillation units and by hydrocracking.

Despite numerous efforts, there is still a need in the state of art for obtaining an efficient and a simultaneous process that can effectively produce high value low aromatic solvents and high-value BTX from the low-value refinery hydrocarbons.

SUMMARY OF THE INVENTION

In an aspect of the present disclosure, there is provided a process for obtaining an aromatic lean stream and an aromatic rich stream from a hydrocarbon feed, the process comprising: (a) obtaining a hydrocarbon feed; and (b) contacting the hydrocarbon feed with a solvent selected from a group consisting of alkyl aromatic hydrophilic polyethylene oxide, polyethylene glycols, and combinations thereof to obtain an aromatic lean stream and an aromatic rich stream.

In another aspect of the present disclosure, there is provided a process for obtaining de-aromatized kerosene (DAK) from a hydrocarbon feed, the process comprising: (a) obtaining a hydrocarbon feed; (b) contacting the hydrocarbon feed with a solvent selected from a group consisting of alkyl aromatic hydrophilic polyethylene oxide, polyethylene glycols, and combinations thereof to obtain an aromatic lean stream; and (c) hydrogenating the aromatic lean stream to obtain de-aromatized kerosene (DAK), wherein the hydrocarbon feed has an aromatic content in the range of 5-40 wt %.

In yet another aspect of the present disclosure, there is provided a process for obtaining BTX from a hydrocarbon feed, the process comprising: (a) obtaining a hydrocarbon feed; (b) contacting the hydrocarbon feed with a solvent selected from a group consisting of alkyl aromatic hydrophilic polyethylene oxide, polyethylene glycols, and combinations thereof to obtain an aromatic rich stream; and (c) treating the aromatic rich stream to obtain BTX, wherein the hydrocarbon feed has an aromatic content in the range of 40-80 wt %.

In one another aspect of the present disclosure, there is provided a simultaneous process for obtaining an aromatic lean stream and an aromatic rich stream from a hydrocarbon feed, the process comprising: (a) obtaining a hydrocarbon feed; and (b) contacting the hydrocarbon feed with a solvent selected from a group consisting of alkyl aromatic hydrophilic polyethylene oxide, polyethylene glycols, and combinations thereof to obtain an aromatic lean stream and an aromatic rich stream.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles “a”, “an” and “the” are used to refer to one or to more than one (i.e., to at least one) of the grammatical object of the article.

The terms “comprise” and “comprising” are used in the inclusive, open sense, meaning that additional elements may be included. It is not intended to be construed as “consists of only”.

The term “hydrocarbon feed” as used herein refers to the crude oil feedstocks in the petroleum refineries. In the present disclosure, the hydrocarbon feed refers to the crude low-value refinery hydrocarbon stream, such as straight-run kerosene, kerosene, light cycle oil, and the like.

The term "aromatic lean stream" as used herein refers to the hydrocarbon stream comprising lower aromatic content especially lowered monoaromatic and polyaromatic hydrocarbons as compared to the hydrocarbon feed. In this present disclosure, the aromatic lean stream refers to a hydrocarbon stream comprising monoaromatic hydrocarbons in the range of 1-10%.

The term "aromatic rich stream" used herein refers to a hydrocarbon stream comprising aromatic content in higher weight percentages, i.e., the aromatic rich stream has aromatic content higher than the aromatic lean stream or the hydrocarbon feed.

The term "de-aromatized kerosene (DAK)" as used herein refers to low aromatic high-value commercially important solvent. The term "de-aromatized kerosene", "DAK", and "high specialty solvents" may be interchangeably used. The de-aromatized kerosene is a solvent having a negligible presence of aromatic hydrocarbons, i.e., monoaromatic hydrocarbons. DAK of the present disclosure typically contain less than 300 ppm of monoaromatic hydrocarbons.

The term "BTX" as used herein refers to high-value aromatic benzene-toluene-xylene.

The term "alkyl aromatic hydrophilic polyethylene oxide" as used herein refers to solvents comprising polyethylene oxide chain with varying number of ethylene oxide repeating units. It also refers to alkyl aromatic polyethylene oxide. Examples may not be limited to Triton-X series, nonylphenol ethoxylate.

The term "polyethylene glycol" as used herein refers to a polyether compound comprising varying oxyethylene groups. In the present disclosure, polyethylene glycol refers to alkyl glycols and alkyl aromatic glycols. Non-limiting examples of polyethylene glycol may be PEG-200, PEG-400, PEG-600, PEG-800, PEG-1500, or PEG-3000.

The term "hydrotreated/hydrotreatment" as used herein refers to a reaction of organic compounds in the presence of high pressure and hydrogen to remove oxygen along with other heteroatoms. In the present disclosure, the term hydrotreatment refers to a process of removing sulfur from the hydrocarbon feed in the presence of a catalyst at a temperature in the range of 280 to 420° C. under high pressure, i.e., 10 to 120 barg. The catalyst may be selected from a group consisting of metals/metal oxides of nickel, molybdenum, cobalt, tungsten, phosphorus, or combinations thereof with non-metallic part consisting of alumina, zeolites, titania, silica, and combinations thereof.

The term "hydrogenation" as used herein refers to the addition of hydrogen to the organic compound in the presence of hydrogen gas and a catalyst. In the present disclosure, the term hydrogenation refers to the process of conversion of the aromatic lean stream into de-aromatized kerosene.

The term "hydrocracking" as used herein refers to a process of catalytic cracking and hydrogenation by employing high pressure and temperature in the presence of a catalyst. In the present disclosure, the term refers to a process involved in the conversion of the aromatic rich stream into BTX.

The term "aromatic reduction efficiency" as used herein refers to the reduction of aromatic content in the hydrocarbon stream. In the present disclosure, it refers to the percentage reduction of aromatic content from the hydrocarbon feed stream to the aromatic lean stream.

Throughout this specification, unless the context requires otherwise the word "comprise", and variations such as "comprises" and "comprising", will be understood to imply the inclusion of a stated element or step or group of element or steps but not the exclusion of any other element or steps.

The term "including" is used to mean "including but not limited to", "including" and "including but not limited to" are used interchangeably.

Unless defined otherwise, all technical and scientific terms used herein have the same meaning as commonly understood to one of ordinary skill in the art to which this disclosure belongs. Although methods and materials similar or equivalent to those described herein can be used in the practice or testing of the disclosure, the preferred methods, and materials are now described. All publications mentioned herein are incorporated herein by reference.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight percentage of about 1% to 10% should be interpreted to include not only the explicitly recited limits of about 1% and 10%, but also to include sub-ranges, such as 1-7%, 5-10%, and so forth, as well as individual amounts, including fractional amounts, within the specified ranges, such as 1.9%, 5.5%, 8.2%, for example. In the present disclosure, the weight percentage is represented as wt %.

The present disclosure is not to be limited in scope by the specific embodiments described herein, which are intended for the purposes of exemplification only. Functionally equivalent products, compositions, and methods are clearly within the scope of the disclosure, as described herein.

There have been many processes reported for obtaining de-aromatized kerosene and BTX. However, there are not many efforts attempted on a simultaneous production of these solvents from a single hydrocarbon feed. In most of the reported works, there are separate and different pathways defined for the production of these high-value low aromatic solvents and high-value high aromatic solvents. Also, the input hydrocarbon feed used to obtain these solvents has been different. Expensive processes are often involved in obtaining the high-value aromatic hydrocarbon solvents. In the present disclosure, low-value refinery hydrocarbon streams have been used to produce the high value low aromatic and high value high aromatic hydrocarbon solvents. The process defined in the present disclosure can simultaneously produce high-value DAK and BTX. For the purpose of producing the high-value DAK and BTX, the hydrocarbon feed can be primarily contacted with a combination of solvent to obtain aromatic lean and aromatic rich streams.

The present disclosure provides a process for obtaining aromatic lean and aromatic rich streams from a hydrocarbon feed by contacting it with a combination of solvents chosen from alkyl aromatic hydrophilic polyethylene oxide and polyethylene glycols. The solvents are chosen from Triton-X series, nonylphenol ethoxylate and polyethylene glycols. Treating the hydrocarbon feed with an appropriate mixture of solvents taken in suitable proportions, may provide aromatic lean stream with low aromatic content, especially lowered monoaromatic content. Simultaneously the stream containing high aromatic can be separated as an aromatic rich stream. The aromatic lean stream can be further processed to obtain DAK and the aromatic rich stream was treated further to produce BTX.

In an implementation of the present disclosure, there is provided a process for obtaining an aromatic lean stream and an aromatic rich stream from a hydrocarbon feed, the process comprising: (a) obtaining a hydrocarbon feed and (b) contacting the hydrocarbon feed with a solvent selected from a group consisting alkyl aromatic hydrophilic polyethylene oxide, polyethylene glycols, and combinations thereof to obtain an aromatic lean stream and an aromatic rich stream. In another implementation of the present disclosure, the hydrocarbon feed is selected from a group consisting of kerosene, straight-run kerosene, light cycle oil, and combinations thereof.

In one non-limiting example, the process for obtaining an aromatic lean stream and an aromatic rich stream from a hydrocarbon feed, includes (a) obtaining kerosene; (b) contacting kerosene with a solvent selected from a group consisting of alkyl aromatic hydrophilic polyethylene oxide, polyethylene glycols, and combinations thereof to obtain an aromatic lean stream and an aromatic rich stream. In another non-limiting example, the hydrocarbon feed is straight-run kerosene. In yet another non-limiting example, the hydrocarbon feed is light cycle oil.

In an implementation of the present disclosure, the hydrocarbon feed has aromatic content in the range of 5 to 40 wt %. In another implementation of the present disclosure, the hydrocarbon feed has an aromatic content in the range of 10 to 30 wt %.

In an implementation of the present disclosure, the hydrocarbon feed has aromatic content in the range of 35 to 80 wt %. In another implementation of the present disclosure, the hydrocarbon feed has an aromatic content in the range of 40 to 70 wt %.

In an implementation of the present disclosure, the hydrocarbon feed is hydrotreated prior to contacting with the solvent to obtain a hydrocarbon feed with 5-15 ppm of sulfur. If the hydrocarbon feed has sulfur content more than 15 ppm, the hydrocarbon feed may be hydrotreated by known processes to obtain a hydrocarbon feed essentially containing sulfur in the range of 5-15 ppm prior to contacting with the solvent. The hydrocarbon feed may be selected from kerosene, straight-run kerosene, light cycle oil. In a non-limiting example, the hydrotreatment of the hydrocarbon feed may be carried out in the presence of a catalyst at a temperature in the range of 280 to 420° C. under a pressure in the range of 10 to 120 barg. In another non-limiting example, the hydrotreatment of the hydrocarbon feed may be carried out in the presence of a catalyst at a temperature in the range of 300 to 400° C. under a pressure in the range of 25 barg to 90 barg. In a non-limiting example, the catalyst for hydrotreatment may be selected from a group consisting of metals/metal oxides of nickel, molybdenum, cobalt, tungsten, phosphorus with non-metallic part consisting of alumina, zeolites, titania, silica, and combinations thereof.

In an implementation of the present disclosure, there is provided a process for obtaining an aromatic lean stream and an aromatic rich stream from a hydrocarbon feed as described herein, the process comprising contacting the hydrocarbon feed with a solvent selected from a group consisting of alkyl aromatic hydrophilic polyethylene oxide, polyethylene glycols, and combinations thereof to obtain an aromatic lean stream and an aromatic rich stream, wherein the hydrocarbon feed to the solvent weight ratio is in the range of 1:1.5 to 1:2.5. In another implementation of the present disclosure, the hydrocarbon feed to the solvent weight ratio is in the range of 1:1.7 to 1:2.2. In yet another implementation of the present disclosure, the hydrocarbon feed to the solvent weight ratio is in the range of 1:1.9 to 1:2.1. In one non-limiting example, the hydrocarbon feed to the solvent weight ratio is 1:2.

In an implementation of the present disclosure, there is provided a process for obtaining an aromatic lean stream and an aromatic rich stream from a hydrocarbon feed, the process comprising contacting the hydrocarbon feed with a solvent selected from a group consisting of alkyl aromatic hydrophilic polyethylene oxide, polyethylene glycols, and combinations thereof to obtain an aromatic lean stream and an aromatic rich stream, wherein the alkyl aromatic hydrophilic polyethylene oxide is selected from Triton™ X series (octylphenol ethoxylates) or nonylphenol ethoxylate; the polyethylene glycols is selected from PEG-200, PEG-400, PEG-600, PEG-800, PEG-1500 or PEG-3000. In one non-limiting example, the solvent is a combination of Triton™ X series and polyethylene glycol. In another non-limiting example, the solvent is selected from Triton™ X-114 (polyoxyethylene(8) octylphenyl ether) or Triton™ X-100 (polyoxyethylene(10) octylphenyl ether). In yet another non-limiting example, the solvent is selected from nonylphenol ethoxylate-X series, wherein X varies from 9 to 100. In a further non-limiting example, the solvent is a combination of Triton™ X-100 and PEG-400.

The process for obtaining an aromatic lean stream and an aromatic rich stream from a hydrocarbon feed includes contacting the hydrocarbon feed with a solvent selected from a group consisting of alkyl aromatic hydrophilic polyethylene oxide, polyethylene glycols, and combinations thereof to obtain an aromatic lean stream and an aromatic rich stream, wherein the solvent is a combination of Triton™ X series and polyethylene glycol. In an implementation of the present disclosure, the Triton™ X series to the polyethylene glycols have a weight ratio in the range of 4:1 to 1:4. In another implementation of the present disclosure, the Triton™ X series to the polyethylene glycols have a weight ratio in the range of 1:3 to 3:1. In yet another implementation of the present disclosure, the Triton™ X series to the polyethylene glycols have a weight ratio in the range of 1:2 to 2:1. In a further implementation of the present disclosure, the Triton™ X series to the polyethylene glycols have a weight ratio of 1:1.

The process for obtaining an aromatic lean stream and an aromatic rich stream from a hydrocarbon feed includes contacting the hydrocarbon feed with a solvent selected from a group consisting of alkyl aromatic hydrophilic polyethylene oxide, polyethylene glycols, and combinations thereof to obtain an aromatic lean stream and an aromatic rich stream, wherein the hydrocarbon feed is contacted with the solvent at a temperature in the range of 10 to 70° C. and at a pressure in the range of 1-15 barg. In an implementation of the present disclosure, the process of contacting the hydrocarbon feed with a solvent is carried out at a temperature in the range of 10 to 70° C. and at a pressure in the range of 1-15 barg. In another implementation of the present disclosure, the process of contacting the hydrocarbon feed with a solvent is carried out at a temperature in the range of 15 to 60° C. and at a pressure in the range of 1-15 barg.

The process for obtaining an aromatic lean stream and an aromatic rich stream from a hydrocarbon feed includes contacting the hydrocarbon feed with a solvent selected from a group consisting of alkyl aromatic hydrophilic polyethylene oxide, polyethylene glycols, and combinations thereof to obtain an aromatic lean stream having monoaromatic hydrocarbons content in the range of 1-10 wt %. In one implementation of the present disclosure, the aromatic lean stream has monoaromatic hydrocarbons in the range of 3 to 9 wt %. In another implementation of the present disclosure, the aromatic lean stream has monoaromatic hydrocarbons content of 5.1 wt %. In yet another implementation of the present disclosure, the aromatic lean stream has monoaromatic hydrocarbons content of 3.4 wt %. In a further implementation of the present disclosure, the aromatic lean stream has monoaromatic hydrocarbons content of 1.9 wt %.

The process for contacting the hydrocarbon feed with the solvent can be repeated at least once by replacing the hydrocarbon stream with the aromatic lean stream and contacting it with the solvent to obtain an aromatic lean stream with aromatic reduction efficiency of at least 50% with respect to the hydrocarbon feed. In an implementation of the present disclosure, particularly repeated once to obtain an aromatic lean stream with aromatic reduction efficiency of at least 50% with respect to the hydrocarbon feed, most particularly repeated at least thrice to obtain an aromatic lean stream with aromatic reduction efficiency of at least 80% with respect to the hydrocarbon feed.

The aromatic lean stream according to the present disclosure is subjected to hydrogenation to obtain de-aromatized kerosene. In one implementation the hydrogenation is a process for conversion of aromatic lean stream into de-aromatized kerosene in the presence of a catalyst at a temperature in the range of 150-350° C. under a pressure in the range of 10-100 barg. In one non-limiting example, the catalyst for hydrogenation is selected from a group consisting of metals/metal oxides of nickel, platinum, palladium, rhenium, rhodium, nickel tungstate, molybdenum with non-metallic part consisting of alumina, zeolites, titania, zirconia, silica and combinations thereof. In one another non-limiting example, the catalyst comprises metal/metal oxides in the weight percentage in the range of 0.5 to 60% with respect to the catalyst.

In one implementation of the present disclosure, the hydrocarbon feed is contacted with the solvent to obtain an aromatic lean stream and an aromatic rich stream. In another implementation of the present disclosure, the aromatic rich stream is further subjected to hydrotreatment and hydrocracking to obtain BTX.

The aromatic rich stream is subjected to hydrotreatment in the presence of a catalyst is done in the presence of a catalyst at a temperature in the range of 280 to 420° C. under a pressure in the range of 10 to 120 barg. The catalyst for hydrotreatment is selected from a group consisting of metals/metal oxides of nickel, molybdenum, cobalt, tungsten, phosphorus, or combinations thereof with non-metallic part consisting of alumina, zeolites, titania, silica, and combinations thereof. The aromatic rich stream is subjected to hydrocracking done in the presence of a catalyst at a temperature in the range of 300 to 450° C. under a pressure in the range of 80 to 150 barg. The catalyst for hydrocracking is selected from a group consisting of metals nickel, molybdenum, cobalt, tungsten, phosphorus, tin, platinum, or combinations thereof with the non-metallic part consisting of alumina, silica, titania, H-beta zeolites, ZSM-5 and combinations thereof.

The process for obtaining de-aromatized kerosene from a hydrocarbon feed comprises (a) obtaining a hydrocarbon feed (b) contacting the hydrocarbon feed with a solvent selected from a group consisting of alkyl aromatic hydrophilic polyethylene oxide, polyethylene glycols, and combinations thereof to obtain an aromatic lean stream; and (c) hydrogenating the aromatic lean stream to obtain de-aromatized kerosene (DAK), wherein the hydrocarbon feed has an aromatic content in the range of 5-40 wt %.

The process for obtaining de-aromatized kerosene by contacting the hydrocarbon feed selected from kerosene, straight-run kerosene with a solvent selected from a group consisting of alkyl aromatic hydrophilic polyethylene oxide, polyethylene glycols, and combinations thereof to obtain an aromatic lean stream; and (c) hydrogenating the aromatic lean stream to obtain de-aromatized kerosene (DAK), wherein the hydrocarbon feed has an aromatic content in the range of 5-40 wt %, preferably in the range of 10-30 wt % of aromatic content.

De-aromatized kerosene having monoaromatic hydrocarbon in the range of 30-190 ppm is obtained by contacting straight-run kerosene with a combination of solvent, particularly Triton™ X-100 and PEG-400 in the ratio of 1:1. The straight-run kerosene can be contacted with the solvent in the ratio range of 1:1.5 to 1:2.5. In another example, the straight-run kerosene to the solvent ratio is 1:2. In case the hydrocarbon feed is kerosene, the ratio range of kerosene to the solvent can be selected from 1:1.7 to 1:2.3 or 1:1.9 to 1:2.1. In one non-limiting example, the ratio of kerosene to the solvent is in the range of 1:1.5 to 1:2.5. In one another non-limiting example, the kerosene is contacted with the solvent in the ratio range selected from 1:1.7, 1:2.3, 1:1.9 and 1:2.1. In another non-limiting example, kerosene and solvent is in the ratio of 1:2. The process for contacting the hydrocarbon feed with the solvent is repeated at least once by replacing the hydrocarbon stream with the aromatic lean stream and contacting it with the solvent to obtain an aromatic lean stream with aromatic reduction efficiency of at least 50% with respect to the hydrocarbon feed, particularly repeated once to obtain an aromatic lean stream with aromatic reduction efficiency of at least 50% with respect to the hydrocarbon feed, most particularly repeated at least thrice to obtain an aromatic lean stream with aromatic reduction efficiency of at least 80% with respect to the hydrocarbon feed.

In one non-limiting example, the hydrocarbon feed is hydrotreated prior to contacting with the solvent so that the sulfur content is in the range of 5-15 ppm. The hydrocarbon feed, such as kerosene and straight-run kerosene having high sulfur content greater than 15 ppm of sulfur is hydrotreated prior to contacting with the solvent. The hydrotreated kerosene or the hydrotreated straight-run kerosene can be contacted with the solvent comprising a 1:1 ratio of Triton™ X-100 and PEG-400 to obtain the aromatic lean stream. The aromatic lean stream can be hydrogenated to obtain the de-aromatized kerosene solvents. In one implementation the hydrogenation is a process for conversion of aromatic lean stream into de-aromatized kerosene in the presence of a catalyst at a temperature in the range of 150-350° C. under a pressure in the range of 10-100 barg. In one non-limiting example, the catalyst for hydrogenation is selected from a group consisting of metals/metal oxides of nickel, platinum, palladium, rhenium, rhodium, nickel tungstate, molybdenum with non-metallic part consisting of alumina, zeolites, titania, zirconia, silica and combinations thereof. In one another non-limiting example, the catalyst comprises metal/metal oxides in the weight percentage in the range of 0.5 to 60% with respect to the catalyst. The obtained de-aromatized kerosene has monoaromatic hydrocarbons in the range of 30-190 ppm. The processes explained in the present disclosure are conducted with hydrocarbon feed selected from kerosene, straight-run kerosene, results in de-aromatized kerosene with the monoaromatic hydrocarbons in the range 30-190 ppm.

A hydrocarbon feed may be processed to obtain BTX from a process comprising (a) obtaining a hydrocarbon feed (b) contacting the hydrocarbon feed with a solvent selected from a group consisting alkyl aromatic hydrophilic polyethylene oxide, polyethylene glycols, and combinations thereof to obtain an aromatic rich stream; and (c) treating the aromatic rich stream to obtain BTX, wherein the hydrocarbon feed has aromatic content in the range of 40-80 wt %. In one non-limiting example, the hydrocarbon feed is selected from straight-run kerosene, light cycle oil, and combinations thereof. In one another non-limiting example, the hydrocarbon feed is light cycle oil. In one implementation, the hydrocarbon feed has aromatic content preferably in the range of 45-70 wt %. In another implementation, the hydrocarbon feed having sulfur greater than 15 ppm is hydrotreated prior to contacting with solvent. The hydrocarbon feed or the hydrotreated hydrocarbon feed is contacting with solvent to obtain an aromatic rich stream. The hydrocarbon feed is made in contact with a combination of solvents selected from the group consisting of alkyl aromatic hydrophilic polyethylene oxide and polyethylene glycols, wherein the alkyl aromatic hydrophilic polyethylene oxide is selected from Triton™ X series, or nonylphenol ethoxylate and the polyethylene glycols is selected from PEG-200, PEG-400, PEG-600, PEG-800, PEG-1500, or PEG-3000. A solvent system comprising Triton™ X-100 and PEG-400 can be contacted with light cycle oil to obtain the aromatic rich stream. The aromatic rich stream is treated by a process selected from hydrotreatment, hydrocracking, and a combination thereof to obtain BTX. In one implementation of the present disclosure, the hydrotreatment is done in the presence of a catalyst at a temperature in the range of 280 to 420° C. preferably at 300 to 400° C. under a pressure in the range of 10 to 120 barg preferably at 25 barg to 90 barg and wherein the catalyst is selected from a group consisting of metals/metal oxides of nickel, molybdenum, cobalt, tungsten, phosphorus, or combinations thereof with non-metallic part consisting of alumina, zeolites, titania, silica, and combinations thereof. In another implementation of the present disclosure, the hydrocracking is done in the presence of a catalyst at a temperature in the range of 300 to 450° C. under a pressure in the range of 80 to 150 barg. The catalyst for hydrocracking is selected from a group consisting of metals nickel, molybdenum, cobalt, tungsten, phosphorus, tin, platinum, or combinations thereof with the non-metallic part consisting of alumina, silica, titania, H-beta zeolites, ZSM-5 and combinations thereof. BTX obtained from the aromatic rich stream has aromatic content in the range of 40-95 wt %.

In one implementation of the present disclosure, a simultaneous process for obtaining an aromatic lean stream and an aromatic rich stream from a hydrocarbon feed, the process comprises (a) obtaining a hydrocarbon feed (b) contacting the hydrocarbon feed with a solvent selected from alkyl aromatic hydrophilic polyethylene oxide and polyethylene glycols. The hydrocarbon feed may be selected from a group consisting of kerosene, straight-run kerosene or light cycle oil. The hydrocarbon feed may have aromatic content in the range of 5-40 wt %. In one non-limiting example, the hydrocarbon feed has aromatic content in the range of 40-80 wt %. The hydrocarbon feed having sulfur content greater than 15 ppm is hydrotreated prior to contacting with solvent. The solvent may be a combination of alkyl aromatic hydrophilic polyethylene oxide selected from Triton™ X series or nonylphenol ethoxylate and the polyethylene glycols selected from PEG-200, PEG-400, PEG-600, PEG-1500 or PEG-3000. The hydrocarbon feed to the solvent is in the ratio range of 1:1.5 to 1:2.5. The ratio range datasets vary as 1:1.7, 1:1.9, 1:2, 1:2.2. In one non-limiting example, the hydrocarbon feed to the solvent is in the ratio of 1:2. The solvent is a combination of Triton™ X series and polyethylene glycols. In one implementation the solvent is Triton™ X-100 and PEG-400 taken in the ratio range of 1:4 to 4:1. The combination of solvent may be taken in the ratio range of 1:3 to 3:1, 1:2 to 2:1. In one non-limiting example, the solvent Triton™ X-100 and PEG-400 is taken in the ratio of 1:1.

In one implementation of the present disclosure, the hydrocarbon feed is contacted with the solvent to obtain an aromatic lean stream and an aromatic rich stream. The contacting is repeated at least once by replacing the hydrocarbon stream with the aromatic lean stream and contacting it with the solvent to obtain an aromatic lean stream with aromatic reduction efficiency of at least 50% with respect to the hydrocarbon feed, particularly repeated once to obtain an aromatic lean stream with aromatic reduction efficiency of at least 50% with respect to the hydrocarbon feed, most particularly repeated at least thrice to obtain an aromatic lean stream with aromatic reduction efficiency of at least 80% with respect to the hydrocarbon feed. The aromatic lean stream has monoaromatic hydrocarbons in the range of 1-10 wt %. The aromatic lean is hydrotreated to obtain de-aromatized kerosene having monoaromatic hydrocarbons in the range of 30-190 ppm. In one implementation the hydrogenation is a process for conversion of the aromatic lean stream into de-aromatized kerosene in the presence of a catalyst at a temperature in the range of 150-350° C. under a pressure in the range of 10-100 barg. In one non-limiting example, the catalyst for hydrogenation is selected from a group consisting of metals/metal oxides of nickel, platinum, palladium, rhenium, rhodium, nickel tungstate, molybdenum with non-metallic part consisting of alumina, zeolites, titania, zirconia, silica and combinations thereof. In one another non-limiting example, the catalyst comprises metal/metal oxides in the weight percentage in the range of 0.5 to 60% with respect to the catalyst.

In another implementation of the present disclosure, the aromatic rich stream obtained by contacting the solvent with the hydrocarbon feed is treated to obtain BTX. The aromatic rich stream is treated by a process selected from hydrotreatment, hydrocracking, and a combination thereof to obtain BTX. In one implementation of the present disclosure, the hydrotreatment is done in the presence of a catalyst at a temperature in the range of 280 to 420° C. preferably at 300 to 400° C. under a pressure in the range of 10 to 120 barg preferably at 25 barg to 90 barg and wherein the catalyst is selected from a group consisting of metals/metal oxides of nickel, molybdenum, cobalt, tungsten, phosphorus, or combinations thereof with non-metallic part consisting of alumina, zeolites, titania, silica, and combinations thereof. In another implementation of the present disclosure, the hydrocracking is done in the presence of a catalyst at a temperature in the range of 300 to 450° C. under a pressure in the range of 80 to 150 barg. The catalyst for hydrocracking is selected from a group consisting of metals nickel, molybdenum, cobalt, tungsten, phosphorus, tin, platinum, or combinations thereof with the non-metallic part consisting of alumina, silica, titania, H-beta zeolites, ZSM-5 and combinations thereof. BTX obtained from the aromatic rich stream has aromatic content in the range of 40-95 wt %.

Although the subject matter has been described in considerable detail with reference to certain preferred embodiments thereof, other embodiments are possible.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices, and materials are described herein. It is to be understood that this disclosure is not limited to particular methods, and experimental conditions described, as such methods and conditions may apply.

As discussed in the background, the petrochemical refineries practice various combinations of processes to produce high-value refined products. There has been a constant search for developing an efficient, effective process for producing high-value solvents such as DAK, BTX from low-value refinery hydrocarbons. The conversion of low-value refinery hydrocarbons into high-value solvents has always been a costly and tedious process. The present disclosure provides a process that can simultaneously produce the high-value low aromatic DAK solvent and high-value high aromatic hydrocarbons BTX from the low-value refinery hydrocarbons. The process involves contacting the low-value refinery hydrocarbon feed with a combination of solvent in a specific ratio and proportion resulting in an aromatic lean stream and aromatic rich stream. The aromatic lean stream and the aromatic rich stream are further processed to obtain the DAK solvent and BTX.

Example 1

I. Hydrocarbon Feed

The present disclosure provides the process for obtaining the aromatic lean stream and aromatic rich stream from a hydrocarbon feed. Various feedstock that can be used as the hydrocarbon feed are gasoline, diesel fuel, fuel gases, liquefied gases and so on. The low refinery hydrocarbons, such as kerosene, straight-run kerosene, light cycle oil was used as hydrocarbon feed for the present disclosure. The process of the present disclosure helps in obtaining high valued products, such as high-value low aromatic DAK solvents and high value high aromatic BTX. The hydrocarbon feed used in the present disclosure to obtain the aromatic lean stream and the aromatic rich stream was straight-run kerosene (SKO). The straight-run kerosene had an aromatic content in the range of 14-30 wt %.

II. Hydrotreatment of the Hydrocarbon Feed

The hydrocarbon feed selected for the process should have sulfur content in the range of 5-15 ppm. When the hydrocarbon feed had sulfur content greater than 15 ppm, hydrotreatment was performed on the hydrocarbon feed. The presence of sulfur in the hydrocarbon feed was undesirable, hence hydrotreatment was performed to remove the sulfur content and other organic impurities such as nitrogen compounds. Sulfur compounds if present in the feed, act as a poison to the hydrogenation catalysts in further conversion processes. Hence it was essential that the hydrocarbon feed had lowered sulfur content, preferably in the range of 5-15 ppm.

Hydrotreatment was done by contacting the hydrocarbon feed, i.e., SKO with a catalyst selected from a group consisting of metals/metal oxides of nickel, molybdenum, cobalt, tungsten, phosphorus, or combinations thereof with non-metallic part consisting of alumina, zeolites, titania, silica, and combinations thereof. The catalyst, i.e., the hydrotreating catalysts had two components, metal component, and support component. The metal component was selected from nickel, cobalt, molybdenum, tungsten, phosphorus, and combinations thereof and the non-metallic support component was selected from alumina, zeolites, titania, silica, and combinations thereof. Nickel, cobalt, phosphorus or tungsten were used as promoter metals and its oxides were present in the catalysts at 1 to 30 wt % range, more specifically 3 to 15 wt %. In another example, molybdenum was also present in the catalysts at 5 to 50 wt %, more specifically 10 to 30 wt %. The non-metallic support component was taken in the range 5 to 15 wt % with respect to SKO feed. The hydrotreatment was performed at a temperature in the range of at 300° C. to 400° C. and under the pressure in the range of 25 barg to 90 barg. The SKO feed flow rates were varied between 0.5 to 4 $hr^{-1}$ LHSV (liquid hourly space velocity), more specifically 1 to 3 $hr^{-1}$ LHSV. Table 1 shows the properties of the SKO feed and the hydrotreated SKO.

TABLE 1

| Properties | SKO - Feed | SKO - hydrotreated |
|---|---|---|
| Sulfur, D4294, ppm | 3200 | 5 |
| Density, D4052, g/cc | 0.8037 | 0.8005 |
| Flash Point, D7094, Deg C. | 62.6 | 67.6 |
| Smoke Point, D1322, mm | 24.1 | 25.7 |
| D86, 5%, Deg C. | 189 | 184.5 |
| D86, 95%, Deg C. | 246 | 243 |
| Aromatics, wt % | 27 | 25.9 |

From Table 1 it can be observed that the SKO feed had 3200 ppm of sulfur whereas the sulfur content in the hydrotreated SKO was 5 ppm. The hydrotreated SKO had aromatics of 25.9 wt % while SKO feed had aromatic content of 27 wt %. The other properties such as density, flash point, smoke point, and the distillation points were comparable between SKO feed and the hydrotreated SKO. It can be inferred that the hydrotreatment had essentially decreased the sulfur content of the SKO feed and had improved properties.

Example 2

Process for Obtaining Aromatic Lean Stream and Aromatic Rich Stream

The hydrocarbon feed from Example 1, was made to contact with solvent as disclosed in the present disclosure. SKO feed having sulfur content in the range of 5-15 ppm was chosen as the hydrocarbon feed.

In an example, SKO-1, SKO-2, and SKO-3 were the SKO feed considered for the demonstration of the present disclosure. The SKO feed had varying initial aromatic content such as SKO-1 with 15.5 wt % of aromatics, SKO-2 had 20.5 wt % of aromatics and SKO-3 had 25.7 wt % of aromatics. The SKO feeds were made to contact with a combination of solvent. Table 2 shows the various solvents chosen in varying ratios, used for contacting with the SKO feed.

TABLE 2

| Solvent Composition | Solvent | Ratio |
|---|---|---|
| 1. | ChCl:DEA | 1:6 |
| 2. | ChCl:OA | 1:1 |
| 3. | ChCl:Urea | 1:2 |
| 4. | ChCl:Glycol | 1:2 |
| 5. | ChCl:Glycerol | 1:2 |

TABLE 2-continued

| Solvent Composition | Solvent | Ratio |
|---|---|---|
| 6. | ChCl:Glycol | 1:6 |
| 7. | TBAB:TEA | 1:3 |
| 8. | TBAB:Glycol | 1:8 |
| 9. | TBAB:PEG-400 | 1:2 |
| 10. | TBAB:PEG-400 | 1:4 |
| 11. | TBAB:PEG-200 | 1:2 |
| 12. | TX-100:PEG-400 | 1:1 |
| 13. | TBAB:Glycol | 1:2 |
| 14. | TBAB:Glycerol | 1:2 |

ChCl: Choline Chloride
TBAB: TetraButylAmmonium Bromide
DEA: Diethanol amine
OA: Oxalic acid
TEA: TriEthanol Amine
TX-100: Triton X 100
PEG: Polyethylene glycol Composition 1 indicates that the solvent used was a combination of choline chloride and diethanol amine in the ratio of 1:6. This solvent composition 1 was made to contact with SKO feed and two different streams were separated out. SKO feeds and the solvent compositions were taken in the ratio of 1:2. Similarly, the solvent composition 2 comprised a 1:1 ratio of choline chloride and oxalic acid. Solvent composition 2 was made to contact with the SKO feed and two different streams were obtained. Furthermore, all the solvent compositions 3-14 were prepared in said ratios as per Table 2 and were made to contact with the SKO feed.

The process of contacting the SKO feed (hydrocarbon feed) with a solvent was carried out in a bench-scale extraction unit of 2-liter capacity. The extraction was done at a temperature in a range of 15 to 60° C. and at a pressure in the range of 1 to 15 barg. SKO feed and the solvent compositions as mentioned in Table 2 were mixed for about 60-90 minutes under a stirring speed of 500-700 rpm.

The process of contacting (i.e.,) the extraction process of SKO feed with the solvent compositions resulted in two different streams. Two streams separated were the dense phase and a lighter raffinate phase. The dense phase comprised the aromatic rich stream and the lighter raffinate phase comprised the aromatic lean stream. The lighter phase was analyzed for the percentage of aromatics present with respect to the SKO feed. The percentage of aromatics in the aromatic lean phase reduced in comparison to the SKO feed. This reduction of aromatics was measured and was denoted as aromatic reduction efficiency. Similarly, SKO feed was extracted using the solvent compositions 1-14 as mentioned in Table 2 and two streams were separated. For each solvent composition used, the aromatic lean stream was analyzed, and the aromatic reduction efficiency was calculated.

In an example, the extraction of SKO feed with the solvent composition produced aromatic lean stream 1 and aromatic rich stream 1. The aromatic lean stream 1 was again subjected to extraction similar to SKO feed as explained above and resulted in aromatic lean stream 2 and aromatic rich stream 2. Aromatic lean stream 2 was further extracted to produce aromatic lean stream 3 and aromatic rich stream 3. The process was repeated to further obtain aromatic lean stream 4 and aromatic rich stream 4. The extraction was repeated to reduce the aromatic content in the aromatic lean stream. The aromatic reduction efficiency of the aromatic lean streams 1, 2, 3 and 4 was measured. For an efficient solvent composition, about 50% aromatic reduction efficiency for the aromatic lean stream 2 was desired. Hence all the solvent compositions 1-14 were tested in the extraction process and the aromatic lean stream 2 was analyzed.

It was surprisingly observed that the solvent composition 12 having Triton™ X-100 and PEG-400 in the ratio of 1:1 was the most favourable solvent composition for the extraction process. The aromatic lean stream 2 obtained using Triton™ X-100 and PEG-400, had 50% aromatic reduction efficiency. The other solvent compositions 1-11 and 13-14 did not yield a 50% aromatic reduction efficiency for the aromatic lean stream 2. Hence were not the best working solvent composition.

The combination of solvents, i.e., Triton™ X-100 and PEG-400 was used for the extraction of various SKO feed and the extraction was repeated to reduce the aromatic content in the aromatic lean stream. SKO feed and the combination of solvents were taken in the ratio of 1:2. Table 3 depicts the results for the process of contacting the various SKO feed with a 1:1 ratio of Triton™ X-100 and PEG-400. The process was performed as explained above and the aromatic reduction efficiency of the aromatic lean stream was measured.

TABLE 3

| | Aromatics (%) | | | | Aromatic Reduction Efficiency |
|---|---|---|---|---|---|
| Hydrocarbon feed | Mono | Di | Poly | Total | (%) |
| SKO-1 (Feed) | 15.5 | — | — | 15.5 | — |
| Aromatic lean stream of SKO-1 | 1.9 | — | — | 1.9 | 88 |
| SKO-2 (Feed) | 19.5 | 1.0 | — | 20.5 | — |
| Aromatic lean stream of SKO-2 | 3.4 | 0.01 | 0.03 | 3.4 | 83 |
| SKO-3 (Feed) | 20.9 | 4.6 | 0.2 | 25.7 | — |
| Aromatic lean stream of SKO-3 | 5.0 | 0.12 | — | 5.1 | 80 |

Table 3 shows the measured aromatic reduction efficiency of the aromatic lean stream. The process of contacting the SKO feed with the solvent Triton™ X-100 and PEG-400 was repeated more than once, preferably repeated thrice, until the aromatic lean stream had reduced aromatic content. From Table 2, it can be observed that after multiple extraction processes the final aromatic lean stream had lesser aromatic content. SKO-1 feed had initial aromatic content of 15.5 wt % and after extraction, the aromatic content reduced to 1.9 wt % and the aromatic reduction efficiency was 88%. Similarly, the SKO-2 had initial aromatic content of 20.5 wt % and the aromatic lean stream had 3.4 wt % of aromatics with 83% of aromatic reduction efficiency. Also, SKO-3 feed was subjected to the extraction process and the obtained aromatic lean stream had 5.1% wt of aromatics with 90% of aromatic reduction efficiency. Thus, it can be derived from the above exemplification, that the combination of solvent Triton™ X-100 and PEG-400 in the ratio of 1:1 was efficient in obtaining an aromatic lean stream of reduced aromatic content and corresponding aromatic rich streams with higher aromatic content.

In another example, the hydrocarbon feed was light cycle oil and the extraction process explained above was performed on the light cycle oil using the combination of solvent Triton™ X-100 and PEG-400 to obtain aromatic lean stream and aromatic rich stream. These streams were subjected to further processing to obtain DAK and BTX.

Example 3

Hydrogenation of Aromatic Lean Stream to Obtain De-Aromatized Kerosene

The aromatic lean stream from Example 2 was hydrogenated to obtain high-value de-aromatized kerosene solvents. The hydrogenation was carried out in the presence of catalysts at a temperature in the range of 150-350 C and under a pressure of 10-100 barg. The hydrogenation catalysts were of two components i.e. metal component and the non-metallic support component. The metal component comprised at least one metal selected from nickel, platinum, palladium, rhenium, rhodium, nickel tungstate, molybdenum and combinations thereof. The support component comprised alumina, silica, titania, zirconia, zeolite and combinations thereof. The metal component was about 0.5 wt % to 60 wt % of the weight of the total catalyst.

In this example, the aromatic lean stream obtained from SKO-3 as explained in example 2 was hydrogenated to obtain de-aromatized kerosene. Hydrogenation was carried out in the presence of nickel on alumina support catalysts at 30 barg pressure with a hydrogen flow rate of 60 $Nm^3/m^3$ of feed flow rate and with weighted average bed catalyst bed temperature (WABT) i.e. reaction temperatures of 160° C. and 165° C. Table 4 shows the de-aromatized kerosene obtained from the hydrogenation of aromatic lean stream of SKO-3 feed.

TABLE 4

| Properties | Aromatic lean stream of SKO-1 (1.9 wt %) | De-aromatized kerosene 1 (WABT: 160° C.) | | De-aromatized kerosene 2 (WABT: 165° C.) | |
|---|---|---|---|---|---|
| Monoaromatic hydrocarbon (ppm) | 19000 | 186 | 183 | 34 | 30 |

Aromatic lean stream from SKO-1 feed had 1.9 wt % of aromatics with an aromatic reduction efficiency of 90%. This was divided into four cuts and hydrogenation was performed separately on these four cuts. The resulting product de-aromatized kerosene had reduced monoaromatic hydrocarbons. It can be observed from Table 4 that the hydrogenation at temperatures 160° C. and 165° C. showed different monoaromatic hydrocarbons. The monoaromatic hydrocarbons were in the range of a 30-19 ppm for the de-aromatized kerosene. The hydrogenation reaction repeated twice at same temperature 160° C. and 165° C. produced same results and the repeatability of the reaction was established. The hydrogenation resulted in the desired high value de-aromatized kerosene solvents with the least monoaromatic hydrocarbons.

Example 4

Process for Obtaining BTX from Aromatic Rich Stream

The aromatic rich stream was obtained as the denser phase when contacting the hydrocarbon feed with the solvent. As explained in example 2, the aromatic rich streams 1, 2, 3 and 4 obtained were collected together and was further processed to obtain BTX.

TABLE 5

| S. no | Sample name | Naphthenes | i-paraffins | n-paraffins | Olefins | Aromatics |
|---|---|---|---|---|---|---|
| 1 | SKO-3 Aromatic rich stream 150-180° C. | 18.86 | 59.47 | 3.78 | 0.10 | 17.79 |
| 2 | SKO-3 Aromatic rich stream 180-200° C. | 14.44 | 56.51 | 1.94 | 0.06 | 27.05 |
| 3 | SKO-3 Aromatic rich stream 200-220° C. | 9.71 | 46.91 | 1.23 | 0.02 | 42.14 |
| 4 | SKO-3 Aromatic rich stream 220-250° C. | 3.60 | 33.78 | 0.70 | — | 61.92 |

Table 5 represent the gas chromatographic analysis data of the SKO-3 aromatic rich stream. The aromatic rich stream was distilled out into four cuts and all the four cuts were analyzed by gas chromatography for paraffins, i-paraffins, aromatics, naphthenes and olefins. It can be observed that aromatic rich phase had monoaromatic hydrocarbons with naphthenes or alkyl group branched in it along with di- or poly-aromatic hydrocarbons. In presence of different hydrocracking catalysts di or poly aromatics gets saturated and became monoaromatics and then was cracked or dealkylated to form benzene-toluene-xylene.

In an example defined herein, the aromatic rich stream was treated by a process selected from hydrotreatment, hydrocracking, and combination thereof to obtain BTX. Hydrotreatment was done in the in the presence of catalyst at a temperature in the range of 280 to 420° C. preferably at 300 to 400° C. under a pressure in the range of 10 to 120 barg preferably at 25 barg to 90 barg and the catalyst was selected from a group consisting of metals/metal oxides of nickel, molybdenum, cobalt, tungsten, phosphorus, or combinations thereof with non-metallic part consisting of alumina, zeolites, titania, silica, and combinations thereof. Hydrocracking was done in the presence of a catalyst at a temperature in the range of 300 to 450° C. preferably in the range of 360 to 430° C. under a pressure in the range of 80 to 150 barg preferably in the range of 40 to 100 barg. The catalyst for hydrocracking was selected from a group consisting of metals nickel, molybdenum, cobalt, tungsten, phosphorus, tin, platinum, or combinations thereof with the non-metallic part consisting of alumina, silica, titania, H-beta zeolites, ZSM-5 and combinations thereof. BTX obtained from aromatic rich stream had aromatic content in the range of 40-95 wt %.

Although the subject matter has been described in considerable detail with reference to certain examples and implementations thereof, other implementations are possible.

Advantages of the Present Disclosure

The present disclosure provides a process for obtaining an aromatic lean stream and an aromatic rich stream from a hydrocarbon feed by contacting the hydrocarbon feed with solvent selected from alkyl aromatic hydrophilic polyethylene oxide, polyethylene glycols and combinations thereof. Solvents Triton™ X-100 and PEG-400 taken in the ratio of 1:1 is used for contacting the hydrocarbon feed to obtain the aromatic lean stream and aromatic rich stream. The hydrocarbon feed and solvent are taken in the ratio of 1:2. The aromatic lean stream obtained by the process defined herein has monoaromatic in the range of 1-10 wt %. The aromatic reduction efficiency for the obtained aromatic lean stream is in the range 80-90%. The aromatic lean stream is hydrogenated to de-aromatized kerosene having monoaromatic hydrocarbons in the range of 30-190 ppm. The aromatic rich stream is hydrotreated/hydrogenated to BTX with high aromatic content in the range of 40-95 wt %. The process defined herein is a simultaneous process for obtaining DAK and BTX. DAK and BTX are commercially high valued solvents that can be derived from the low value refinery hydrocarbons using the process disclosed herein.

We claim:

1. A process for obtaining an aromatic lean stream and an aromatic rich stream from a hydrocarbon feed, the process comprising:

a) obtaining a hydrocarbon feed; and b) contacting the hydrocarbon feed with solvents to obtain an aromatic lean stream and an aromatic rich stream, wherein the solvents are an alkyl aromatic hydrophilic polyethylene oxide and polyethylene glycol-400 (PEG-400) in a weight ratio of 1:1, wherein the alkyl aromatic hydrophilic polyethylene oxide is selected from the group consisting of polyoxyethylene(10) octylphenyl ether and polyoxyethylene(8) octylphenyl ether.

2. The process as claimed in claim 1, wherein the hydrocarbon feed is selected from the group consisting of kerosene, straight-run kerosene, light cycle oil, and combinations thereof.

3. The process as claimed in claim 1, wherein the hydrocarbon feed is hydrotreated prior to contacting with the solvents to obtain a hydrotreated hydrocarbon feed with 5-15 ppm of sulfur.

4. The process as claimed in claim 1, wherein the hydrocarbon feed and the solvents are in a weight ratio in a range of from 1:1.5 to 1:2.5.

5. The process as claimed in claim 1, wherein the hydrocarbon feed is contacted with the solvents at a temperature in a range of from 10 to 70° C. and at a pressure in a range of from 1 to 15 barg.

6. The process as claimed in claim 1, wherein the step (b) is repeated at least once by replacing the hydrocarbon feed with the aromatic lean stream and contacting the aromatic lean stream with the solvents to obtain the aromatic lean stream with an aromatic reduction efficiency of at least 50% with respect to the hydrocarbon feed.

7. The process as claimed in claim 1, wherein the aromatic lean stream is subjected to hydrogenation to obtain a de-aromatized kerosene and wherein the aromatic rich stream is further treated by a process selected from the group consisting of hydrotreating, hydrocracking, and combinations thereof to obtain BTX (benzene-toluene-xylene).

8. A process for obtaining de-aromatized kerosene (DAK) from a hydrocarbon feed, the process comprising:

a) obtaining a hydrocarbon feed;

b) contacting the hydrocarbon feed with solvents to obtain an aromatic lean stream, wherein the solvents are an alkyl aromatic hydrophilic polyethylene oxide and polyethylene glycol-400 (PEG-400) in a weight ratio of 1:1; and c) hydrogenating the aromatic lean stream to obtain de-aromatized kerosene (DAK), wherein the hydrocarbon feed has an aromatic content in a range of 5-40 wt %, and wherein the alkyl aromatic hydrophilic polyethylene oxide is selected from the group consisting of polyoxyethylene(10) octylphenyl ether and polyoxyethylene(8) octylphenyl ether.

9. The process as claimed in claim 8, wherein the hydrocarbon feed is selected from the group consisting of kerosene, straight-run kerosene, and combinations thereof.

10. The process as claimed in claim 8, wherein the hydrocarbon feed is hydrotreated prior to contacting with the solvents to obtain a hydrotreated hydrocarbon feed with less than 15 ppm of sulfur.

11. The process as claimed in claim 8, wherein the hydrocarbon feed and the solvents are in a weight ratio in a range of from 1:1.5 to 1:2.5.

12. The process as claimed in claim 8, wherein the hydrocarbon feed is contacted with the solvents at a temperature in a range of from 10 to 70° C. and at a pressure in a range of from 1 to 15 barg.

13. The process as claimed in claim 8, wherein the hydrocarbon feed is contacted with the solvents to obtain an aromatic lean stream having monoaromatic hydrocarbons content in a range of from 1 to 10 wt %.

14. The process as claimed in claim 8, wherein the step (b) is repeated at least once by replacing the hydrocarbon stream with the aromatic lean stream and contacting the aromatic lean stream with the solvents to obtain the aromatic lean stream with an aromatic reduction efficiency of at least 50% with respect to the hydrocarbon feed.

15. The process as claimed in claim 8, wherein the de-aromatized kerosene has an aromatic content in a range of from 30 to 190 ppm by weight.

16. A process for obtaining BTX (benzene-toluene-xylene) from a hydrocarbon feed, the process comprising:

a) obtaining a hydrocarbon feed;

b) contacting the hydrocarbon feed with solvents to obtain an aromatic rich stream, wherein the solvents are an alkyl aromatic hydrophilic polyethylene oxide and polyethylene glycol-400 (PEG-400) in a weight ratio of 1:1; and c) treating the aromatic rich stream to obtain BTX, wherein the hydrocarbon feed has an aromatic content in a range of 40-80 wt %, and wherein the alkyl aromatic hydrophilic polyethylene oxide is selected from the group consisting of polyoxyethylene(10) octylphenyl ether and polyoxyethylene(8) octylphenyl ether.

17. The process as claimed in claim 16, wherein the hydrocarbon feed is selected from the group consisting of straight-run kerosene, light cycle oil, and combinations thereof.

18. The process as claimed in claim 16, wherein the hydrocarbon feed is hydrotreated prior to contacting with the solvents to obtain a hydrotreated hydrocarbon feed with less than 15 ppm of sulfur.

19. The process as claimed in claim 16, wherein the hydrocarbon feed to the solvent weight ratio is in a range of from 1:1.5 to 1:2.5.

20. The process as claimed in claim 16, wherein the hydrocarbon feed is contacted with the solvent at a temperature in a range of from 10 to 70° C. and at a pressure in a range of from 1 to 15 barg.

* * * * *